US005857416A

United States Patent [19]

Donnell, Jr. et al.

[11] Patent Number: 5,857,416

[45] Date of Patent: Jan. 12, 1999

[54] MOLDED PALLET HAVING CORRUGATED DECK WITH LEAK IDENTIFICATION AND RETENTION

[75] Inventors: Emerson B. Donnell, Jr., Basking Ridge, N.J.; Didier Winkelmann, Richmond, Va.

[73] Assignee: Polymerpallet Corp., Richmond, Va.

[21] Appl. No.: 850,746

[22] Filed: May 2, 1997

[51] Int. Cl.[6] ..... B65D 19/44

[52] U.S. Cl. ..... 108/55.3; 108/57.13; 108/57.28

[58] Field of Search ..... 108/51.11, 55.1, 108/55.3, 57.13, 57.18, 57.28, 57.29; 206/386

[56] References Cited

U.S. PATENT DOCUMENTS

| | | | |
|---|---|---|---|
| 3,140,672 | 7/1964 | DeLuca | 108/55.3 |
| 3,561,375 | 2/1971 | Hammond et al. . | |
| 3,563,184 | 2/1971 | Angelbeck, Jr. . | |
| 3,611,952 | 10/1971 | Hoffman . | |
| 3,640,229 | 2/1972 | Bell . | |
| 3,695,188 | 10/1972 | Granatstein | 108/57.28 |
| 3,702,100 | 11/1972 | Wharton . | |
| 3,709,160 | 1/1973 | Howard et al. . | |
| 3,762,342 | 10/1973 | Lawlor . | |
| 3,948,190 | 4/1976 | Cook, III et al. . | |
| 4,254,873 | 3/1981 | Cook, III et al. . | |
| 4,263,855 | 4/1981 | Lawlor . | |
| 4,413,737 | 11/1983 | Wind . | |
| 4,562,718 | 1/1986 | Dunk . | |
| 4,843,975 | 7/1989 | Welsch et al. . | |
| 4,930,632 | 6/1990 | Eckert et al. . | |
| 5,092,251 | 3/1992 | Hamaker et al. . | |
| 5,147,039 | 9/1992 | Sechler et al. . | |
| 5,168,817 | 12/1992 | Nulle et al. | 108/57.29 |
| 5,249,699 | 10/1993 | Williams . | |
| 5,359,955 | 11/1994 | Grebenyuk . | |

*Primary Examiner*—Jose V. Chen
*Assistant Examiner*—Gerald A. Anderson
*Attorney, Agent, or Firm*—McDermott, Will & Emery

[57] ABSTRACT

A plastic molded pallet includes a corrugated deck providing structural rigidity to the pallet and forming channels for directing leaking fluid away from drums. The pallet also includes a plurality of troughs for selectively collecting the leaking fluid from the channels. Corner troughs flush with the channels collect the leaking fluid from any channel having the fluid. If a corner trough overflows, mid-section troughs on each side of the corner trough begin to collect the overflowing fluid after the overflowing fluid reaches over the mid-section trough dam. If both mid-section troughs are filled, the leaking fluid then proceeds to the next adjacent corner trough, during which time the leaking drum can still be identified based upon the leakage pattern. After all corner and mid-section troughs are filled, the fluid begins collecting in a center trough. The corrugations in the deck isolate the leaking fluid from the drums, and provide concentric surfaces for supporting different-sized drums.

23 Claims, 5 Drawing Sheets

Figure 5
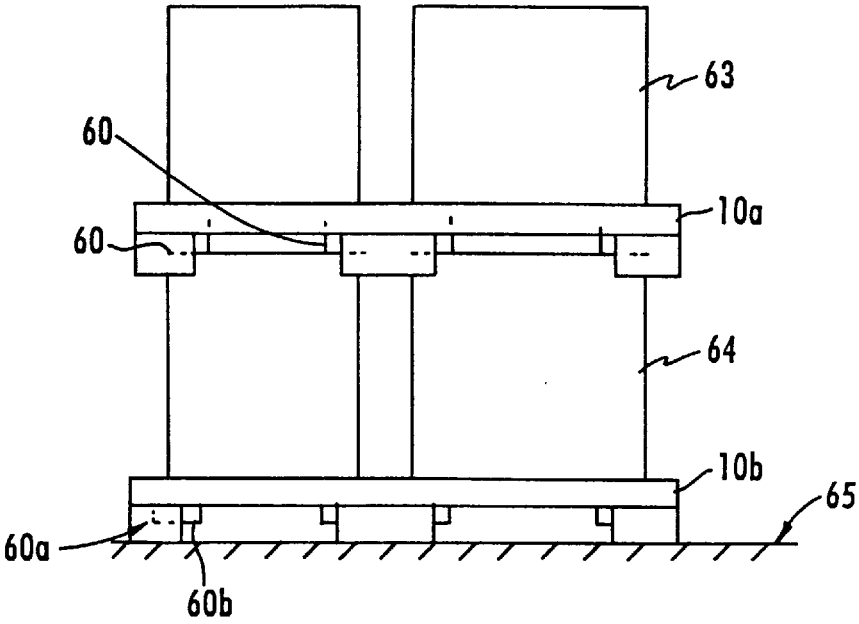
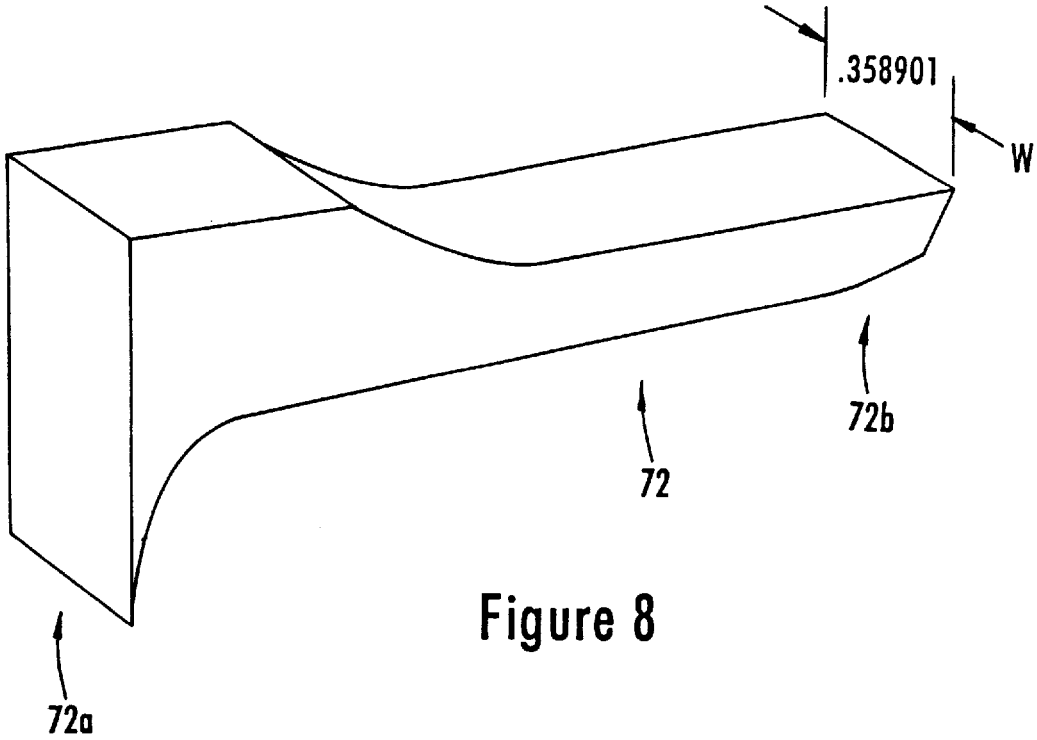
Figure 8

MOLDED PALLET HAVING CORRUGATED DECK WITH LEAK IDENTIFICATION AND RETENTION

BACKGROUND OF THE INVENTION

1. Field of the Invention

This invention relates to pallets made from molded plastic for holding liquid-filled drums.

2. Description of the Related Art

Plastic pallets have been developed in an effort to provide an adequate support structure for carrying liquid-filled drums, while at the same time being able to contain leaking fluid from leaky containers.

Different configurations have been attempted to provide molded pallets having sufficient structural strength to distribute weight during loading. For example, U.S. Pat. No. 3,702,100 to Wharton discloses a molded pallet having a generally corrugated structure, where the corrugations in the medial portion of the pallet are formed in concentric rectangles so as to reinforce each other and minimize distortion when racking. A series of spaced corrugations are also positioned in parallel relation to each side of the pallet. The disclosed pallet also includes ribs spaced between the corrugations to provide additional reinforcement and to act as stacking supports when the pallets are nested to prevent jamming and sticking of one pallet within another.

One problem associated with pallets is that the drums loaded on the pallet may begin to leak, which may cause severe environmental contamination if the leaking fluid is not contained. Although the pallet described in Wharton is not designed for the collection and retention of fluid, U.S. Pat. No. 5,359,955 to Grebenyuk discloses a spill pallet for supporting drums containing hazardous material, where the pallet includes a base and a grate upon which a number of drums are placed. The base includes a support surface which vertically abuts the grate, and bowl-shaped chambers positioned beneath the support surface to receive and contain spilled or leaked liquid. However, the relatively large size of the containers renders the pallet unstable when carried by a forklift. Moreover, the use of a two-piece pallet having a grate and a base with a chamber renders the pallet impractical for use and storage since the pallet requires two separate parts that must be kept together.

A more fundamental problem with the Grebenyuk pallet, as well as other prior art pallets, is that it is unable to identify the leaking drum because the bowl-shaped chambers are fluidly connected to optimize available retention volume, requiring a person to individually inspect each drum to determine which drum is leaking. If the leak is a slow leak, a person may be unable to determine the leaky drum at all. The use of a grate also covers the leaking fluid, preventing someone from visually observing the presence of a leak. Hence, a leaky drum may be left unnoticed, preventing a person to visually detect the leak and take corrective measures.

DISCLOSURE OF THE INVENTION

There is a need for an integrated molded pallet that securely supports fluid-carrying drums for transport by a forklift while providing an early leak detection and identification system to uniquely identify a leaky drum.

There is also a need for a molded pallet that is lightweight and provides sufficient rigidity to enable stacking with other pallets carrying fluid-filled drums, wherein each stacked pallet includes a leak identification and retention system.

There is also a need for a stackable pallet having a leak identification and retention system that can be drained without removal of the pallet from a stack.

There is also a need for a molded pallet configured to securely support different sized drums, while at the same time having a leak retention system that isolates leaking fluid from adjacent drums.

These and other needs are attained by the present invention, where a molded pallet includes a plurality of corner troughs, mid-section troughs, and a center trough, where the troughs are configured to isolate a leaky drum as long as possible to enable identification of the leaking drum and to prevent possible contamination of the adjacent drums, using a set of channels formed on the pallet deck that provide structural rigidity to the pallet while carrying away leaking fluid to the troughs.

According to one aspect of the present invention, a molded pallet includes a pallet deck having quadrants for accommodating liquid-filled drums, where each quadrant has a first dam having a first dam height relative to the pallet deck for isolating leaking fluid of the corresponding drum from leaking into adjacent quadrants, each quadrant also including a set of channels for directing the leaking fluid away from the corresponding drum. The molded pallet also includes corner troughs positioned at each corner of the pallet, each corner trough positioned for collecting the leaking fluid from the corresponding drum via the corresponding channels. A plurality of mid-section troughs, each positioned between two adjacent quadrants, have a set of second dams having a prescribed second dam height less than the first dam height, for collecting liquid fluid having exceeded the second dam height from at least one of the corresponding two adjacent quadrants. A center trough positioned at the center of the pallet and having a set of third dams with a height greater than the second dam heights and less than the first dam height collects leaking fluid that has exceeded the second dam height and third dam height from one of the quadrants.

The above-described molded pallet of the present invention enables fluid from a slow leak to be isolated to specific troughs in order to enable identification of the drum having the leak. Each corner trough first collects the leaking fluid from the corresponding channel underneath the corresponding drum, to enable immediate collection of the leaking material from the corresponding drum. If the corner trough reaches capacity, an adjacent mid-section trough will begin to collect the leaking material once the leaking material in the channels exceeds the height of the mid-section trough dam. Continued leaking will cause filling of the remaining corner and central outer troughs, although the leaky drum can still be identified even up to the point that three corner troughs are filled. The center trough ensures that if the leak is severe, the overflowing material will flow into the center trough to contain the leaking material.

Hence, the above-described molded pallet enables identification and retention of a drum having a slow leak. The integral molded pallet ensures that the leaking drum can be easily identified upon visual inspection of the corner and mid-section troughs. Moreover, the unitary structure of the molded pallet provides for easy handling and storage, as well as light weight.

Another aspect of the present invention provides a molded pallet having a pallet deck with a set of first dams defining quadrants for isolating leaking fluid from respective drums, a first set of parallel corrugations, a second set of parallel corrugations, and third support surfaces located in each of the respective quadrants between the first and second parallel corrugations and extending in a direction bisecting the corresponding quadrant between the center of the pallet and the corresponding corner of the pallet. The first set of parallel corrugations has edges extending in longitudinal direction parallel to an edge of the pallet and spaced along a transverse direction of the pallet, and at least some of the first set of parallel corrugations extend along the longitudinal direction into longitudinally adjacent quadrants. The second set of parallel corrugations have edges extending in the transverse direction and spaced along the longitudinal direction, where at least some of the second set of parallel corrugation extend in the transverse direction into transversely adjacent quadrants.

The configuration of the first and second set of parallel corrugations in combination with the third support surfaces form channels for directing leaking fluid away from a drum. Corner troughs are positioned at each corner of the pallet for collecting the leaking fluid from the channels, and mid-section troughs are positioned for isolating leaking fluid having overflowed at least one of the corner troughs of the adjacent quadrants. Hence, the molded pallet provides a series of corrugations in combination with support surfaces that provide structural rigidity to the pallet, and that form channels useful in directing leaking fluid away from a drum. The corner troughs collect the leaking fluid from the channels, and the first dam and mid-section troughs ensure that the leaking fluid is isolated, even in the instance where leaking fluid has overflowed at least one of the corner troughs.

Hence, the pallet of the present invention is configured to provide sufficient structural rigidity to support four steel 55-gallon drums weighing 1,000 pounds each, and to have sufficient stiffness for carrying by a forklift and stacking with multiple drum-laden pallets. The support and reinforcing corrugations are positioned to also form channels that isolate leaking fluid, enabling early identification of a leaking pallet while protecting adjacent drums from contamination.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein:

FIG. 5 is a diagram illustrating the pallet of FIG. 1 used in a stacked arrangement.

FIG. 8. is a diagram illustrating in detail the reinforcing, rib member used to provide structural rigidity to the deck at the position corresponding to the inner lip of FIG. 1.

BEST MODE FOR CARRYING OUT THE INVENTION

Figure 1:
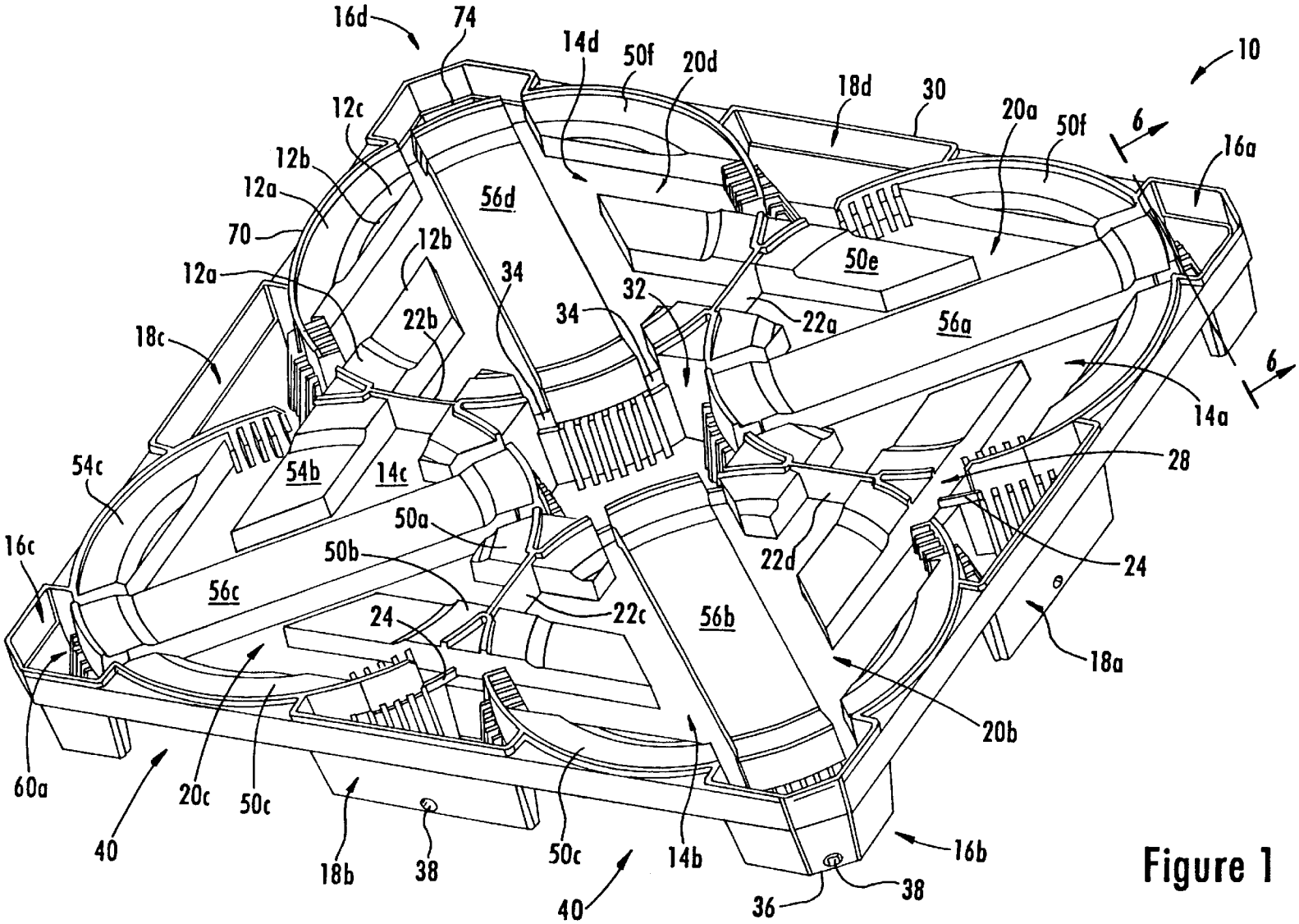
FIG. 1 is a diagram illustrating a perspective top view of a molded pallet according to an embodiment of the present invention.
Figure 2:
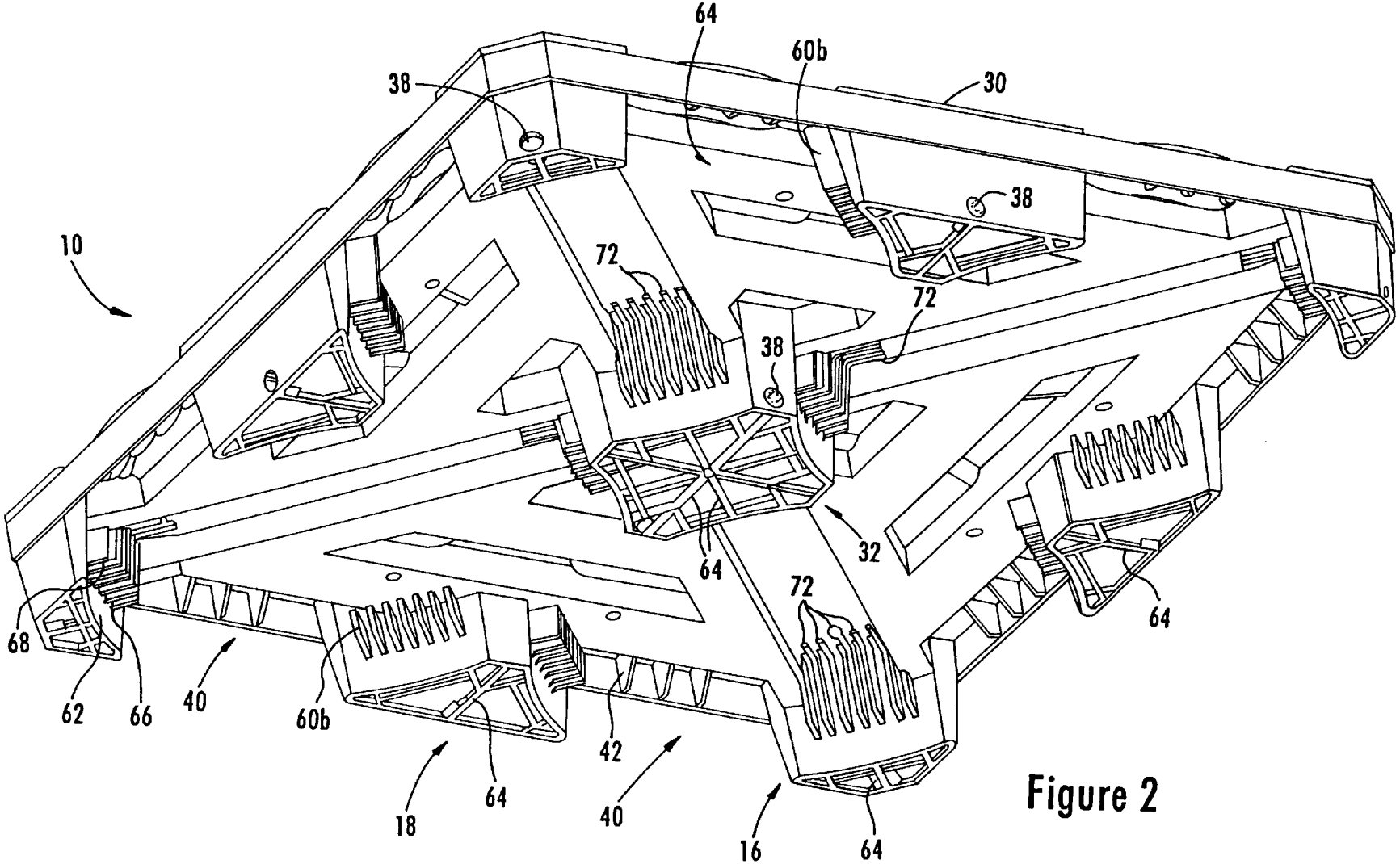
FIG. 2 is a diagram illustrating a perspective underside view of the pallet of FIG. 1.

FIGS. 1 and 2 are diagrams illustrating perspective views of the top side and underside of the molded pallet, respectively, according to an embodiment of the present invention. The pallet 10 is preferably made from high density polyethylene (HDPE), for example molded from Escorene® brand linear polyethylene (HD-6706) injection molding resin available from Exxon Chemical Company. The pallet 10 is designed in a manner to ensure that stiffness is imparted as necessary to provide sufficient structural rigidity to support the barrels securely. One aspect of stiffness is providing stiffness across the fork when a loaded pallet is carried by a forklift. As described below, the pallet is symmetrically square using a "star shaped" corrugated deck 12 providing stiffness across forks when carried by a forklift, ensuring that the barrels do not tip off the nose of the fork or to the side. The corrugated deck is used because of its inherent relative stiffness in one direction compared to a ribbed deck. Use of the corrugated deck 12 improves the area moment by sixty percent (60%) over conventional ribbed decking.

The pallet 10 is configured to have overall dimensions of 48 inch length, 48 inch width, by 5⅞ inch height. The static loaded capacity of the pallet is four steel 55 gallon drums weighing 1,000 pounds each, at room temperature for a minimum of one year, with stacking of three loaded pallets. Dynamic load capacity is 4,000 pounds.

The pallet provides pan-shaped leakage collection to collect a capacity of 18 gallons of fluid, and provides partitions with cascading spillways to immediately identify a leaking drum. Specifically, the pallet 10 includes a plurality of troughs for collecting leaking fluid from channels 14 formed within the corrugations. The pallet 10 includes four corner troughs 16, also referred to as corner feet, that are flushed with the channels 14 to collect the leaking fluid from the corresponding set of channels. Hence, since each corner trough 16 has no dam, any leakage will first enter the corner trough 16 from the corresponding set of channels 14. The pallet 10 also includes four mid-section troughs 18, each positioned between two adjacent quadrants 20 of the pallet. Each quadrant 20 has a dam 22 that isolates leaking fluid of a corresponding drum from leaking from a channel 14 into adjacent quadrants. For example, if quadrant 20*a* held a drum that had a slow leak, the dams 22*a* and 22*d* would prevent the leaking fluid from contaminating quadrants 22*d* and 22*b*, respectively. However, since the channels 14*a* of quadrant 20*a* have limited capacity, the corner trough 16*a* corresponding to quadrant 20*a* collects the leaking fluid from the set of channels 14*a*. Once the corner trough of quadrant 20*a* has reached capacity, the leaking fluid will begin to accumulate in the channels 14*a*.

Figure 7:
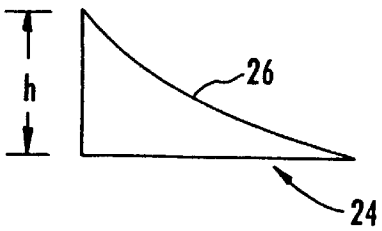
FIG. 7 is a diagram illustrating a cross-sectional view of an inclined dam of the mid-section trough of FIG. 1.

A mid-section trough will begin collecting leaking fluid once the fluid has begun overflowing the corner trough 16*a* corresponding to the quadrant 20*a* having the leaking drum. Each mid-section trough 18 has an inclined dam 24 having a prescribed height less than the height of the dams 22 separating the quadrants. A cross-section of the inclined dam 24 is shown in FIG. 7. The inclined dam 24 has a height h less than the height of the dam 22 separating the quadrants 20, and includes an inclined surface 26 to direct fluid away from the mid-section trough 18 until the leaking fluid in the channel 14*a* has a height exceeding the height h of the inclined dam 26. Specifically, if a leaking drum positioned within quadrant 20*a* had a leak near the inclined dam 24 at edge location 28, the leaking liquid could flow prematurely into the mid-section trough 18*a* if the dam 24 had a level top surface. Hence, the inclined dam 24 ensures that any leaking fluid near the edge 28 of the quadrant 20*a* proximate to the inclined dam 24 will be directed away from the mid-section trough 18*a*, ensuring that the mid-section trough 18*a* does not begin collecting liquid until after the fluid level in the channel 14*a* has exceeded the height H of the inclined dam 24.

Continuing with the above example, assuming that the quadrant 20*a* held a leaking drum, the fluid would be directed away from the drum by the channel 14*a* and collected within the corner trough 16*a*. Once the corner trough 16*a* is full, the leaking fluid will rise in the channel 14*a* and begin to collect within the mid-section troughs 18*a* and 18*d*. The top rim 30 of the pallet, also referred to as the peripheral barrier, has a height substantially greater than the height of the inclined dam 24, and the height of the top rim 30 preferably is equal to the height of the dams 22 separating the quadrants. Hence, the mid-section troughs 18 will fill with liquid before the liquid reaches the top rim 30 on an uneven floor. Similarly, the lowest dam 24 has sufficient height to maximize the odds of liquid entering intended corner trough 16 first, even when the pallet is not level. According to the preferred embodiment, the inclined dam 24 will hold back liquid up to the point where the pallet tilts ½ inch in two feet (half a pallet width) at which point the liquid will pour over the inclined dam 24 into the mid-section trough 18.

Continued leaking will cause the mid-section troughs 18*a* and 18*d* to begin collecting leaking fluid from the channels 14*a* after the corner trough 16*a* has reached capacity and after the fluid level in the troughs 14*a* exceeds the height H of the inclined dams 24. Continued leaking will cause the mid-section troughs 18*a* and 18*d* to fill.

If continued leaking of the drum in quadrant 20*a* causes the mid-section troughs 18*a* and 18*d* to fill, the leaking fluid will overflow the inclined dams 24 into the channels 14*b* and 14*d* of quadrants 20*b* and 20*d* respectively. Once the fluid has entered the channels 14*b* and 14*d*, the fluid will be immediately collected by the corner troughs 16*b* and 16*d*, respectively. If the leaking in quadrant 20*a* continues, the corner troughs 16*b* and 16*d* will continue to collect the fluid overflowing from the mid-section troughs 18*a* and 18*d*.

It will be particularly appreciated that although leaking fluid has moved from quadrant 20*a* to quadrants 20*b* and 20*d*, the liquid is still retained within the channels 14*b* and 14*d*, ensuring that the drums resting on the corrugated deck 12 are elevated above the leaking fluid. Hence, the drums supported in quadrants 20*b* and 20*d* remain isolated from the leaking fluid. Moreover, an individual can still visually identify quadrant 20*a* as the leaking drum, since the presence of fluid in troughs 16*b*, 16*d*, 18*a*, 18*d*, and 16*a* leads to the conclusion that quadrant 20*a* holds the leaking drum because the trough 16*a* is at the center of the fluid collection pattern.

The pallet 10 also includes a center trough 32 positioned at the center of the pallet and having a set of third dams 34 having a height of 1 inch. Hence, if leaking fluid continues to fill all the remaining troughs 16 and 18, the center trough will begin to collect leaking fluid having exceeded the center trough dam height of 1 inch. Moreover, the deck is preferably configured such that the upper surface 12*a* is higher than the center trough dam, as described in detail below. Hence, none of the non-leaking drums will come into contact with the leaking fluid until absolutely necessary, i.e., after the leaking fluid has completely filled the center trough 32 and risen above the level of the corrugated deck 12.

The peripheral barrier 30 and each of the dams 22 have a height greater than the dams 34 of the center trough 32. For example, the peripheral barrier 30 and the center dam 34 may have a height of 1⅜ inches to 1½ inches relative to the channel level 14 in the deck 12. Hence, even if the fluid begins overflowing the center trough 32, the top rim 30 provides an additional barrier, enabling the entire area of the pallet to be used as a last resort for additional retention capacity. Calculations have shown the disclosed pallet having dimensions of 48 inch length by 48 inch width by 5⅞ inch height, molded from high density polyethylene to a weight of 37.2 pounds will produce a pallet having a containment capacity of 18 gallons of fluid. Hence, the disclosed pallet provides an advantageous arrangement providing a unitary, compact pallet having relatively light weight and capable of identifying a leaky drum, and which provides substantial retention capacity (almost 33%) for a leak in an industrial 55-gallon drum.

The disclosed pallet also provides the additional advantage of forming the channels 14 by a combination of star-shaped corrugations, described below, which provide additional stiffness to minimize bending and creeping, while at the same time providing sufficient structural strength to enable stacking of multiple pallets carrying fluid-filled drums. These star-shaped corrugations and other reinforcing structures provide structural rigidity to the pallet. Hence, the pallet 10 has sufficient rigidity to provide a dynamic load capacity of 4,000 pounds, and a static load capacity of four 55-gallon steel drums weighing 1,000 pounds each, with stacking of three loaded pallets.

Figure 3:
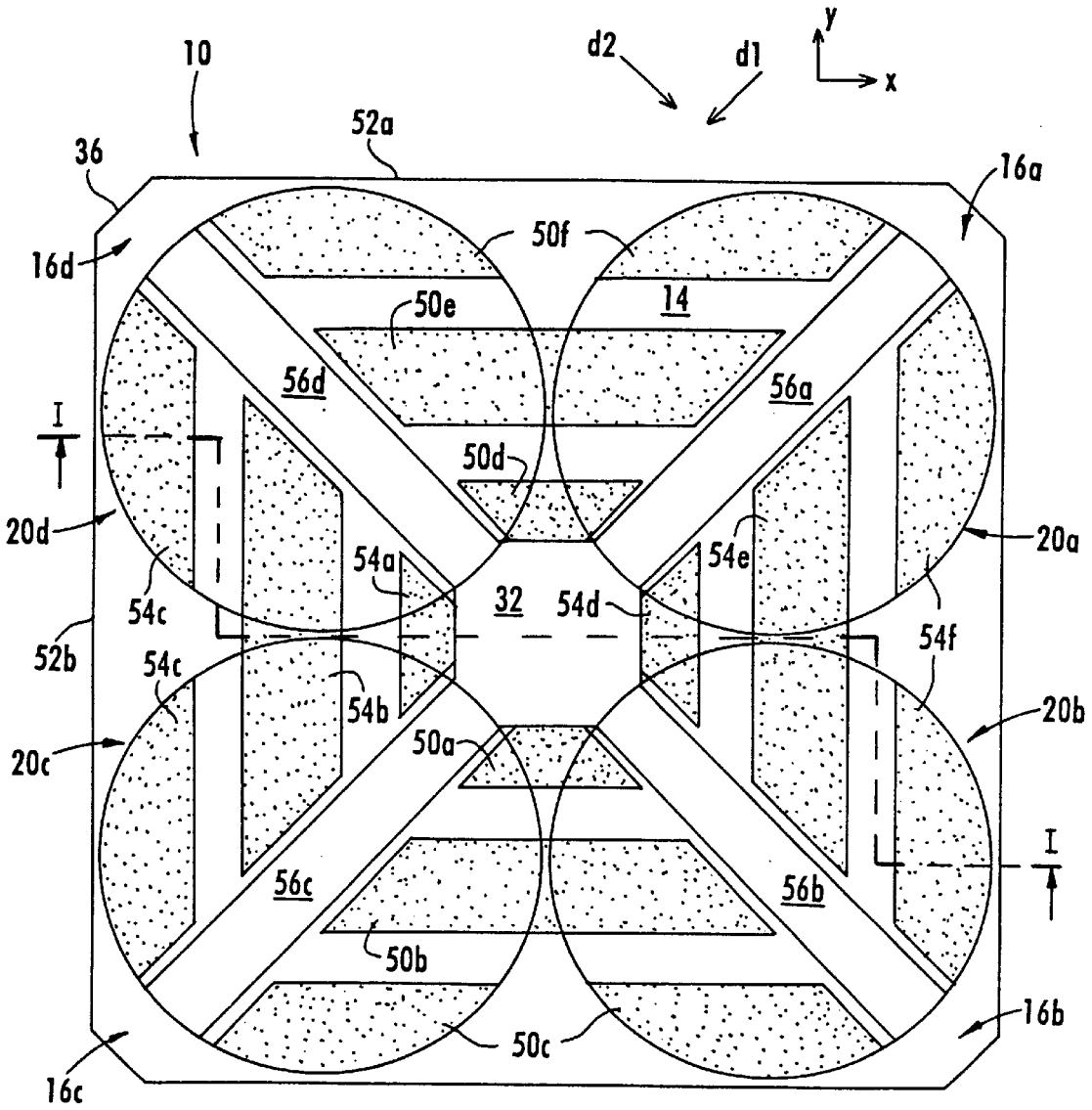
FIG. 3 is a top view illustrating the corrugations of the pallet of FIG. 1.
Figure 4:
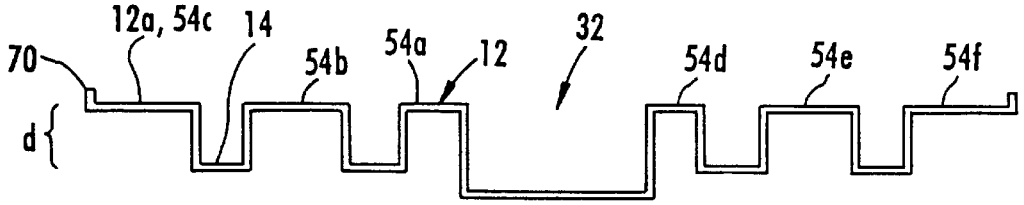
FIG. 4 is a cross-section of the pallet of FIG. 3 taken along lines I—I and illustrating the pallet deck corrugations.

FIG. 3 is a top view of pallet deck 12, with emphasis on the shape of the corrugated deck 12. The pallet 10 includes a series of star-shaped corrugations that form the channels 14 and at the same time provide substantial stiffness and rigidity to support the loaded barrels securely. The details of the troughs and gussets positioned within the troughs, described below, are omitted for clarity. In addition, the views of FIGS. 3 and 4 show a corrugation deck having a single support surface 12*a* for supporting a drum. As described in detail below, the pallet of FIG. 1 also includes a secondary support surface 12*b* for supporting a smaller diameter-sized drum, which is omitted in FIGS. 3 and 4 for clarity.

FIG. 4 is a cross-section of the pallet of FIG. 3 along lines I—I. As shown in FIGS. 3 and 4, the corrugated deck 12 includes an upper primary support surface 12*a* and a lower surface corresponding to the channels 14. The total corrugation depth D is 1.8 inches, and the corrugation thickness of the corrugated deck 12 is one-quarter inch thick molded polymer.

As shown in FIG. 3, the pallet deck 12 includes a first set of parallel corrugations 50 having edges extending in a longitudinal direction x, parallel to a pallet edge 52*a*. The edges of the first set of corrugations 50 are spaced along the transverse direction y of the pallet 10, and hence are spaced relative to pallet edge 52*b*. At least a portion of the first set of parallel corrugations 50 extend in the longitudinal direction x into longitudinally adjacent quadrants. For example, the upper corrugations 50*a* and 50*b* extend in the longitudinal direction x into the adjacent quadrants 20*b* and 20*c*, and the corrugations 50*d* and 50*e* extend in the longitudinal direction x into longitudinally adjacent quadrants 20*a* and 20*d*.

The corrugated deck 12 also includes a second set of parallel corrugations 54 that have edges extending in the transverse direction y and spaced along the longitudinal direction x. At least a portion of the second set of parallel corrugations also extend in the transverse direction y into transversely adjacent quadrants. Hence, corrugations 54*a* and 54*b* extend in the transverse direction y into transversely adjacent quadrants 20*c* and 20*d*, and corrugations 54*d* and 54*e* extend in the transverse direction y into transversely adjacent quadrants 20*a* and 20*b*.

Hence, the first and second set of parallel corrugations 50 and 54 provide a symmetric corrugation pattern that provides rigidity in two separate directions orthogonal to each other, ensuring that a load from a drum in one of the quadrants does not cause bending or deformation (i.e., "creep") in the pallet. The first and second set of corrugations 50 and 54 are also used in combination with a series of support surfaces 56 to form the channels 14 for directing the leaking fluid away from the corresponding drum. Specifically, each quadrant 20 includes a support surface 56 positioned between the first set of parallel corrugations 50 and the second set of parallel corrugations 54 in the corresponding quadrant 20. For example, the support surface 56*a* in quadrant 20*a* is positioned between the first set of corrugations 50*d*, 50*e*, and 50*f* and the second set of corrugations 54*d*, 54*e*, and 54*f*. In addition, the support surface 56*a* extends in a diagonal direction d1 that bisects the quadrant 20*a* between the center trough 32 and the corner trough 16*a*. Hence, the support surface 56*a*, the first set of parallel corrugations 50*d*, 50*e*, and 50*f* in the quadrant 20*a*, and the second set of parallel corrugations 54*d*, 54*e*, and 54*f* in the quadrant 20*a* form the set of channels 14 for the quadrant 20*a*.

Hence, the star-shaped corrugations of FIG. 3 provide structural rigidity for the pallet 10, while at the same time being positioned to form the channels 14, enabling leaking fluid to be directed away from the drums. In addition, the corner trough 16 and the mid-section troughs 18 are joined with the outer corrugations 50*c*, 50*f*, 54*c*, and 54*f*, while the center trough 32 is joined with the corrugated sections 50*a*, 50*d*, 54*a*, and 54*d*, enabling the channels 14 to direct fluid between the troughs while avoiding direct contact of the drums with the leaking fluid.

The disclosed pallet 10 provides the additional feature of having enhanced stiffness within each of the troughs 16, 18, and 32 using a plurality of gussets 60. Each trough includes an inner gusset 60*a* and an outer gusset 60*b* as shown in FIGS. 1 and 2, respectively, integrally formed to provide structural rigidity to the corresponding trough and to enable transfer of weight to a lower drum when the pallet is stacked.

Figure 6:
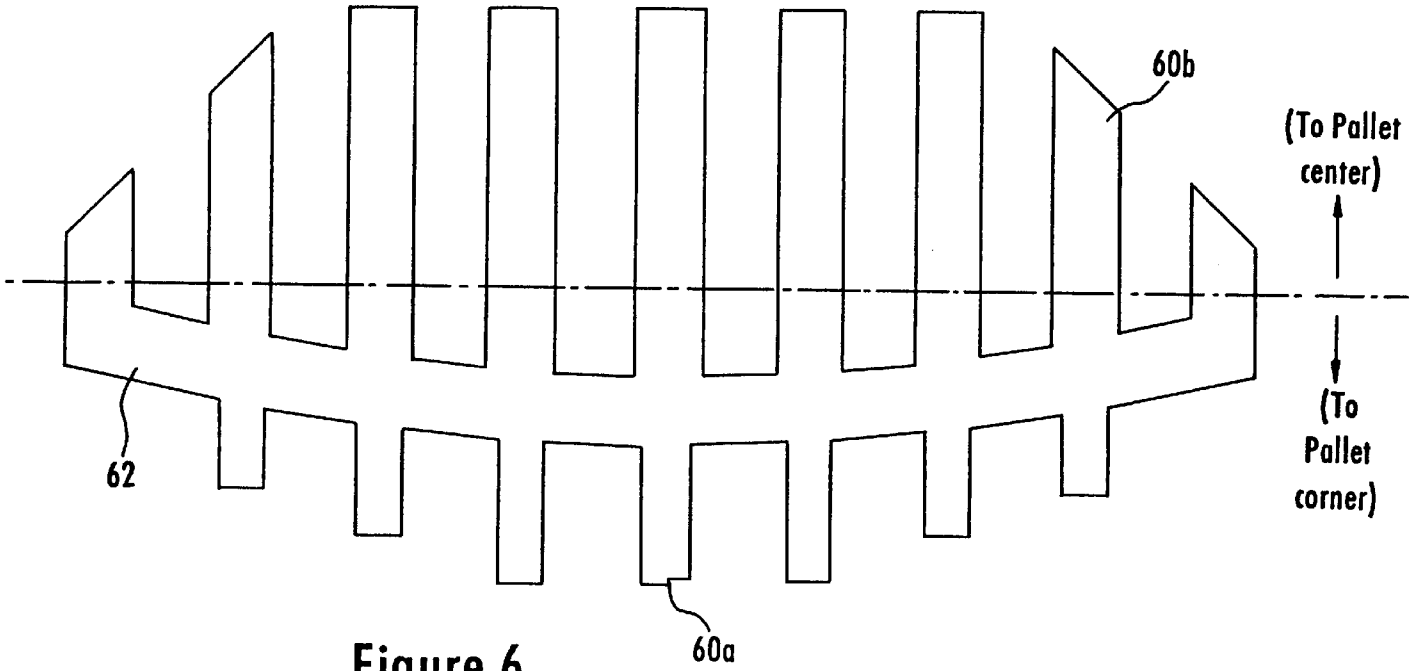
FIG. 6 is a cross-sectional top view of the gussets within a corner trough taken along line 6—6 of FIG. 1.

FIG. 6 is a cross-section of one of the corner troughs 16 taken along line 6—6 of FIG. 1 showing the inner gusset 60*a* and the outer gusset 60*b*, divided by the wall 62 of the corner trough 16. The outer gussets 60*b*, shown in FIG. 2, support the corresponding trough relative to the underside 64 of the pallet deck 12. Each outer gusset 60*b* extends from the corresponding trough toward the center of the corresponding quadrant.

The outer gussets 60*b* are positioned to transfer loading between stacked drums. For example, FIG. 5 is an example of the pallet 10 supporting loading drums 63 while stacked on top of supporting drums 64. The outer gussets 60*b* register with the supporting drums 64 and transfer loading imparted by the drums 63 to the supporting drums 64 underneath the pallet 10. Hence, if pallet 10*a* is loaded with four 55-gallon drums 63 each filled with liquid, the corrugated deck 12 will transfer the loading to the outer gussets 60*b*, which in turn will transfer the loading imparted by the drum 63 on the pallet 10 to the supporting drums 64.

With respect to the pallet 10*b* resting on the floor 65, the weight of the drums, including any additional stacked pallets, will be transferred to the inner gussets 60*a* and the outer gussets 60*b*. The inner gussets 60*a* will help maintain the rigidity of the troughs to minimize deformation. Moreover, each of the troughs have reinforcing ribs 64, shown in FIG. 2, to further minimize deformation of the trough (i.e., the feet). Hence, the load is transferred from the corrugated deck 12 to the gussets 60*a* and 60*b* to the floor 65 while minimizing deformation in the corner troughs 16, the mid-section troughs 18, and the center trough 32.

The gussets 60*b* are configured in each quadrant to accommodate a drum having an upper outer diameter of up to 23⅞ inches in order to securely register the pallet 10*a* with the supporting drums 64. As shown in FIG. 2, each outer gusset 60*b* includes a curve 66 at the gusset edge and forms a step between the gusset 60*b* and the surface 62 of the trough. Hence, the curve 66 at the gusset edge and the step 68 of the gusset enables the outer gusset 60*b* to register with the top rim of a lower drum 64 in a stack.

As shown in FIG. 1, each corner foot 16 has a corresponding angled corner 36 enabling a pallet containing a capacity of up to 18 gallons of leaking fluid to be easily tilted on its edge for drainage. Each of the corner troughs 16 and the mid-section troughs 18 and the center trough 32 also have a drain hole 38 that accommodates a drain plug (not shown). Hence, if the pallet 10 is stacked on top of other drums, the pallet holding the leaking fluid can be emptied without moving the pallet by removing the drain plug from a corresponding drain hole and collecting the leaking fluid. Alternatively, a user may decide to empty a pallet resting on the floor by opening the drain hole 38 of one of the corner troughs 16, and elevating the opposite corner of the pallet 11 to facilitate drainage of the pallet into an appropriate disposal system.

As shown in FIG. 2, the pallet also includes fork tunnel entrances 40 between each corner trough 16 and each mid-section trough 18. The fork tunnel entrance 40 includes ribs 42 positioned on the underside of the pallet deck 12 and provides structural rigidity to the fork tunnel entrance 40. Hence, the ribs 42 maintain the structural integrity of the fork tunnel entrance in the event that the forks of a forklift may accidently collide with the surface of the fork tunnel entrance 40.

Another particular feature of the disclosed pallet is that the pallet can securely support different sized drums. Specifically, conventional pallets are configured to support only 55-gallon size drums having ANSI specification MH2-1991 (3.8), and the barrel typically has a bottom diameter of 23 inches and a top diameter of up to 23¾ inches. Other industries such as the citrus juice industry, however, use drums having different configurations. For example, one design uses a conic drum, where the bottom surface has a curved edge and a bottom diameter of 19.63 inches, a height of 38 inches, and a top diameter of 23.45 inches.

The disclosed pallet 10 is configured to accommodate both the conventional 55-gallon cylindrical drums having a diameter of approximately 23 inches, and the conic-shaped drums used in the citrus juice industry having a rounded bottom and a bottom diameter of 19.63 inches. As shown in FIG. 1, each of the corrugation surfaces in the pallet deck 12 (i.e., surfaces 50, 54, and 56) include an upper surface level 12*a* and a lower surface level 12*b* for supporting the larger and smaller diameter-sized drums, respectively. The lower surface level 12*b* is positioned within the upper surface level 12*a* of the corresponding quadrant 20. The upper and lower surface levels 12*a* and 12*b* are joined by a surface interface 12*c* between the upper surface level 12*a* and the lower surface level 12*b* that corresponds to the curved edge of the conic-shaped drum. According to the disclosed embodiment, the surface interface 12*c* and the lower surface level 12*b* are positioned as concentric circles within the upper surface level 12*a* in each corresponding quadrant.

The upper surface level 12*a* also includes a tapered lip 70 having a 7° taper and corresponding to an edge of the larger 55-gallon size drum. The tapered lip 70 secures the drum while also facilitating removal. The tapered lip 70 may also have a corresponding recess in the pallet opposing the lip that securely nests the bottom rim of the 55-gallon drum on the pallet, while at the same time allowing easy removal of the drum. Hence, the upper surface 12*a* and the lower surface 12*b* enable the pallet to be used to support either the conventional 55-gallon size drums or the conic-shaped drums, and the tapered lip 70 and the surface interface 12*c* enable registration of the bottom edges of the 55-gallon drum and the conic-shaped drums, respectively.

A reinforcing rib member provides additional rigidity for supporting the conic-shaped drums. The gussets on each of the corner troughs 16 and the center trough 32 include at least one gusset 60 having a reinforcing rib member 72 that extends from the corresponding gusset 60 toward the corresponding center of the underside of the pallet deck 12 to a position that corresponds to the surface interface 12*c* on the upper side of the deck. The reinforcing rib member provides structural rigidity to the deck 12 at the position corresponding to the surface interface 12*c* in order to transfer loading imparted by the smaller diameter-sized drum from the deck to the gussets 60. Hence, the pallet 10 is stackable for conic-shaped drums, since the reinforcing rib member 72 extends to the position of the surface interface in order to transfer the weight from the surface interface region to the gussets. A perspective view of the reinforcing rib members is shown in FIG. 8, where the end portion 72*a* is joined with the corresponding gusset 60, and the second end portion 72*b* corresponds to the position of the surface interface 12*c*. If desired, the reinforcing rib member 72 can be further extended to provide additional rigidity underneath the secondary support surface.

The pallet 10 is also stackable for storage. The corner leg includes an inner edge 74 to allow a nesting of 2 inches for stacking of pallets for storage. The top edge of the inner gussets 60*a* also correspond to the inner edge 74 for efficient stacking of pallets.

According to the present invention, a plurality of channels formed from a plurality of corrugations direct leaking fluid away from drums toward fluid receptacles that retain the leaking fluid and enable identification of a leaking drum. The disclosed arrangement provides a plastic molded pallet formed by injection molding of high density polyethylene capable of supporting four steel 55-gallon drums weighing 1,000 pounds each and capable of collecting up to 18 gallons of leaking fluid, where the pallet can have a weight of as little as 37.2 pounds. Hence, the present invention provides a compact pallet that is sufficiently rigid to stack three loaded pallets, retain fluid from slow leaks, and have a sufficiently compact shape to enable easy storage of multiple stacked pallets when not in use.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A molded pallet comprising:

a pallet deck having quadrants, each quadrant for accommodating a drum, each quadrant having a first dam having a first dam height for isolating fluid leaking from the accommodated drum from adjacent quadrants, each quadrant further having a set of channels formed in the pallet deck for directing the fluid away from the leaking drum;

a corner trough positioned at each corner of the pallet for a corresponding quadrant, each trough collecting the fluid from the corresponding quadrants set of channels;

a mid-section trough positioned between each two adjacent quadrants having a set of second dams between the mid-section troughs and the sets of channels of the adjacent quadrants having a second dam height, less than the first dam height, for collecting leaking fluid having exceeded the second dam height from at least one of the corresponding two adjacent quadrants; and a center trough positioned at a center of the pallet and a set of third dams between the center trough and the sets of channels of each quadrant having a third dam height, greater than the second dam height and less than the first dam height, for collecting leaking fluid having exceeded the third dam height from at least one of the quadrants.

2. The pallet of claim 1, wherein the pallet deck further comprises:

a first set of parallel corrugations having edges extending in a longitudinal direction parallel to an edge of the pallet and spaced across a transverse direction the pallet, at least a portion of the first set of parallel corrugations extending into longitudinally adjacent quadrants;

a second set of parallel corrugations having edges extending in the transverse direction and spaced across the longitudinal direction, at least a portion of the second set of parallel corrugations extending into transversely adjacent quadrants; and a support surface in each quadrant, each support surface positioned between the first and the second sets of parallel corrugations in the corresponding quadrant and extending in a third direction bisecting the corresponding quadrant between the center trough and the corner trough, said support surface and the first and the second sets of parallel corrugations in each quadrant positioned to form the corresponding quadrants set of channels.

3. The pallet of claim 2, wherein the support surfaces and the first and the second sets of parallel corrugations of each quadrant comprise:

upper and lower surface levels for supporting larger and smaller diameter-sized drums, respectively, the lower surface levels configured within the upper surface levels; and a surface interface between the upper and lower surface levels corresponding to an edge of the smaller diameter-sized drum enabling registration thereof within the pallet.

4. The pallet of claim 3, wherein the surface interface and the lower surface levels are positioned as concentric circles within the upper surface levels of the corresponding quadrant.

5. The pallet of claim 4, wherein the upper surface levels include a tapered lip corresponding to an edge of the larger diameter-sized drum enabling registration thereof within the pallet.

6. The pallet of claim 5, wherein the corner troughs, the mid-section troughs, and the center trough each have a plurality of gussets supporting the corresponding trough relative to an underside of the pallet deck, each gusset extending from the corresponding trough toward a center of the corresponding quadrant.

7. The pallet of claim 6, wherein the gussets extending toward a quadrant center are positioned to register with a drum underneath the pallet and transfer loading imparted by the drum accommodated by the quadrant above the drum underneath the pallet.

8. The pallet of claim 7, wherein the gussets of a trough further extend into the trough.

9. The pallet of claim 7, wherein at least one of the gussets at each of the corner troughs and the center trough include a reinforcing rib member extending from the corresponding gusset toward the corresponding quadrant center along the underside of the pallet deck to at least a position corresponding to the surface interface, the reinforcing rib member providing structural rigidity to the deck at said position corresponding to the surface interface.

10. The pallet of claim 2, wherein the corner troughs, the mid-section troughs, and the center trough each have a plurality of gussets supporting the corresponding trough relative to an underside of the pallet deck, each gusset extending from the corresponding trough toward a center of the corresponding quadrants.

11. The pallet of claim 10, wherein the gussets extending toward a corresponding quadrant center are positioned to register with a drum underneath the pallet.

12. The pallet of claim 11, wherein the gussets of a trough further extend into the trough.

13. The pallet of claim 12, further comprising fork tunnel entrances between each corner trough and each mid-section trough, each fork tunnel entrance including ribs positioned on the underside of the pallet deck and providing structural rigidity to the fork tunnel entrances.

14. The pallet of claim 12, wherein:

the support surfaces and the first and second sets of parallel corrugations each having an outer lip corresponding to an edge of a larger diameter-sized drum and an inner lip corresponding to an edge of a smaller diameter-sized drum; and at least one of the gussets on each of the corner troughs and the center trough include a reinforcing rib member extending toward the quadrant center along the underside of the pallet deck to a position corresponding to the inner lip positions, the reinforcing rib member providing structural rigidity to the deck at said position corresponding to the inner lip.

15. The pallet of claim 1, further comprising a peripheral barrier having a height greater than the first dam height, relative to the pallet deck, for containing leaking fluid having filled the corner troughs, the mid-section troughs, and the center trough.

16. The pallet of claim 1, wherein each said corner trough has an angled corner edge enabling the pallet to be tilted on said edge.

17. The pallet of claim 16, wherein each of the troughs include a drain hole enabling said each trough to be selectively drained of the collected leaking fluid.

18. A molded pallet comprising:

a pallet deck having:

a set of first dams defining quadrants, each set for isolating fluid from an accommodated leaking drum, a first set of parallel corrugations having edges extending in a longitudinal direction parallel to an edge of the pallet and spaced across a transverse direction of the pallet, at least a portion of the first set of parallel corrugations extending into longitudinally adjacent quadrants, a second set of parallel corrugations having edges extending in the transverse direction and spaced across the longitudinal direction, at least a portion of the second set of parallel corrugations extending into transversely adjacent quadrants, and a support surface in each quadrant, each support surface positioned between the first and the second sets of parallel corrugations in the corresponding quadrant and extending in a third direction bisecting the corresponding quadrant between a center of the pallet and a corner of the pallet, wherein said support surface and the first and second set of parallel corrugations in each quadrant are spaced to form channels for directing leaking fluid away from a drum;

corner troughs positioned at each corner of the pallet for collecting the leaking fluid from the channels of the quadrant; and mid-section troughs, each positioned at a boundary of two adjacent quadrants and in communication with at least one of the channels of each adjacent quadrant, for collecting leaking fluid having overflowed at least one of the corner troughs and said at least one channel of an adjacent quadrant.

19. The pallet of claim 18, further comprising gussets positioned on an underside of the deck, each gusset extending from one of the troughs toward a corresponding quadrant center and configured to provide structural rigidity to the corresponding trough, the gussets of a corresponding quadrant positioned to transfer the load imparted by a drum on the corresponding quadrant to another drum underneath the pallet and registered with said gussets.

20. The pallet of claim 19, wherein each quadrant further comprises an outer lip corresponding to an edge of a larger diameter-sized drum and an inner lip corresponding to an edge of a smaller diameter-sized drum.

21. The pallet of claim 20, further comprising a reinforcing rib member extending from at least one gusset in each quadrant to a position corresponding to the inner lip, the reinforcing rib member providing structural rigidity to the deck at said position corresponding to the inner lip.

22. The pallet of claim 18, further comprising a center trough for collecting fluid overflowing the corner troughs, the mid-section troughs and channels.

23. The pallet of claim 18, wherein each mid-section trough has inclined dams directing leaking fluid away from the corresponding mid-section trough.

* * * * *